US007840146B2

(12) United States Patent
Murauchi et al.

(10) Patent No.: US 7,840,146 B2
(45) Date of Patent: Nov. 23, 2010

(54) DEVELOPING DEVICE AND IMAGE FORMING APPARATUS

(75) Inventors: Junji Murauchi, Toyokawa (JP); Megumi Minami, Amagasaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 117 days.

(21) Appl. No.: 12/191,802

(22) Filed: Aug. 14, 2008

(65) Prior Publication Data

US 2009/0060534 A1 Mar. 5, 2009

(30) Foreign Application Priority Data

Aug. 29, 2007 (JP) ..... 2007-222494

(51) Int. Cl.
*G03G 15/08* (2006.01)

(52) U.S. Cl. ..... 399/30; 399/257; 399/258

(58) Field of Classification Search ..... 399/257, 399/30, 53, 62, 258
See application file for complete search history.

(56) References Cited

U.S. PATENT DOCUMENTS

| | | | | |
|---|---|---|---|---|
| 5,101,231 | A * | 3/1992 | Saitoh | 399/29 |
| 5,504,557 | A | 4/1996 | Morita | |
| 7,269,364 | B2 * | 9/2007 | Tanaka et al. | 399/257 X |
| 7,340,189 | B2 * | 3/2008 | Itagaki et al. | 399/257 X |
| 2003/0228164 | A1 * | 12/2003 | Katoh | 399/30 |

FOREIGN PATENT DOCUMENTS

| | | | |
|---|---|---|---|
| JP | 59-100471 | A | 6/1984 |
| JP | 06-124031 | | 5/1994 |
| JP | 10-171248 | | 6/1998 |
| JP | 2002-196546 | A * | 7/2002 |
| JP | 2006-234935 | | 9/2006 |
| JP | 2007-108623 | | 4/2007 |

OTHER PUBLICATIONS

Machine translation of JP 2007-108623 A dated Feb. 25, 2010.*
Notification of Reason for Refusal issued in corresponding Japanese Application No. 2007-222494 dated Sep. 24, 2009, and an English Translation thereof.

* cited by examiner

*Primary Examiner*—Sophia S Chen
(74) *Attorney, Agent, or Firm*—Buchanan Ingersoll & Rooney PC

(57) ABSTRACT

A developing device has stirring members for conveying and stirring a developer-tank-contained developer and a developer holder, and has a developer replenishing tank for replenishing a replenishment developer to a developer tank; a toner concentration detecting sensor; a discharging mechanism for discharging an excessive amount of the developer-tank-contained developer outside the developer tank when the amount of the developer-tank-contained developer inside the developer tank exceeds a predetermined amount; and a control unit for replenishing the developer-tank-contained developer when it is detected that the toner concentration inside the developer tank is lower than a first reference value and for forcibly consuming the toner inside the developer tank and replenishing the replenishment developer when it is detected that the toner concentration inside the developer tank is higher than a second reference value that is higher than the first reference value.

20 Claims, 7 Drawing Sheets

DEVELOPING DEVICE AND IMAGE FORMING APPARATUS

This application is based on applications No. 2007-222494 filed in Japan, the contents of which are hereby incorporated by reference.

BACKGROUND OF THE INVENTION

1. Field of the Invention

The present invention relates to a developing device for use in an electrophotographic image forming apparatus and to an image forming apparatus incorporating the developing device. More particularly, the present invention relates to a trickle developing device that gradually supplies fresh developer and gradually discharge deteriorated developer and to an image forming apparatus incorporating the developing device.

2. Description of the Related Art

As developing systems employed for electrophotographic image forming apparatuses, the one-component developing system in which toner is used as the main component of the developer and the two-component developing system in which toner and carrier are used as the main components of the developer are known.

The two-component developing system that uses toner and carrier, in which the toner and carrier are charged by friction contact therebetween to predetermined polarities, has a characteristic that the stress on the toner is less than that in the one-component developing system that uses a one-component developer. Since the surface area of the carrier is larger than that of the toner, the carrier is less contaminated with the toner attached to the surface thereof. However, with the use for a long period, contamination (spent) attached to the surface of the carrier increases, whereby the capability of charging the toner is reduced gradually. As a result, problems of photographic fog and toner scattering occur. Although it is conceivable that the amount of the carrier stored in a two-component developing device is increased to extend the life of the developing device, this is undesirable because the developing device becomes larger in size.

To solve the problems encountered in the two-component developer, Patent document 1 discloses a trickle developing device being characterized in that fresh developer is gradually replenished into the developing device and developer deteriorated in charging capability is gradually discharged from the developing device, whereby the increase of the deteriorated carrier is suppressed. The developing device is configured to maintain the volume level of the developer inside the developing device approximately constant by discharging an excessive amount of deteriorated developer using the change in the volume of the developer. In the trickle developing device, the deteriorated carrier inside the developing device is gradually replaced with fresh carrier, and the charging performance of the carrier inside the developing device can be maintained approximately constant.

[Patent document 1] Japanese Patent Application Laid-Open Publication No. Sho 59-100471

However, since the volume of the developer inside the developing device changes depending on the concentration of toner and the deteriorated state of carrier, that is, the state of the developer inside the developing device, the ratio of the ingredients constituting the developer becomes different even if the volume of the developer remains the same.

The concentration of the toner inside the developing device is detected using, for example, a toner concentration detecting sensor that detects the permeability of the developer. For this reason, the measurement accuracy of the toner concentration detecting sensor is not sufficiently high, and the toner concentration indicated as a measured value may be different from the true toner concentration. In addition, the toner concentration obtained using the toner concentration detecting sensor may indicate a toner concentration different from the true toner concentration depending on the filling state of the developer around the toner concentration detecting sensor and the changes in the ambient environment of the image forming apparatus.

Because of various factors such as those described above, the toner concentration obtained using the toner concentration detecting sensor may be detected to be higher than a first reference toner concentration that is assumed to be appropriate. Since the trickle developing device is controlled such that the volume level of the developer inside the developing device is maintained approximately constant, if the toner concentration is detected to be high for some reason, the developer is not replenished for a while and ordinary image formation is carried out continuously until the toner concentration inside the developing device returns to the appropriate first reference toner concentration. When the toner concentration inside the developing device has returned to the reference toner concentration, the amount of the toner inside the developing device, that is, the amount of the developer, becomes scarce, and the volume level of the developer inside the developing device lowers. The fact that the volume level of the developer inside the developing device lowers indicates that the developer inside the developing device is insufficient. A stirring screw is used to stir the developer inside the developing device, and the stirring screw is usually disposed along the developing roller to convey the developer in the longitudinal direction of the developing roller while stirring the developer. When the developer is conveyed using the stirring screw in this state, the low concentration portion of the developer is also moved as the spiral of the screw is moved, whereby uneven supply to the developing roller corresponding to the movement of the screw occurs. As a result, the influence of the uneven supply of the toner appears on formed images. Hence, in the conventional trickle developing device, the so-called screw irregularity phenomenon reflecting the uneven supply of the toner due to the use of the stirring screw occurs, and there is a problem of being unable to maintain high-quality images.

Accordingly, the technical problem to be solved by the present invention is to provide a developing device and an image forming apparatus capable of carrying out excellent image formation for a long period by making the fluctuations in the toner concentration and the volume level of the developer inside a trickle developing device that uses a two-component developer as small as possible.

SUMMARY OF THE INVENTION

To solve the above-mentioned technical problem, the present invention provides a developing device having stirring members for stirring a developer-tank-contained developer containing toner and carrier inside a developer tank while conveying the developer and a developer holder disposed adjacent to the stirring members to supply the stirred developer-tank-contained developer to an electrostatic latent image holder, comprising:

a developer replenishing tank for replenishing a replenishment developer containing the toner and the carrier to the developer tank, a toner concentration detecting sensor for detecting the toner concentration inside the developer tank, a discharging mechanism provided in the developer tank to discharge an excessive amount of the developer-tank-contained developer outside the developer tank when the amount of the developer-tank-contained developer inside the developer tank exceeds a predetermined amount, and control unit for replenishing the replenishment developer when it is detected that the toner concentration inside the developer tank is lower than a first reference value and for forcibly consuming the toner inside the developer tank and replenishing the replenishment developer when it is detected that the toner concentration inside the developer tank is higher than a second reference value that is higher than the first reference value.

In the above-mentioned developing device, when it is detected that the toner concentration inside the developer tank is lower than the first reference value (that is, the first reference toner concentration), ordinary replenishment operation of replenishing the replenishment developer from the developer replenishing tank to the developer tank is carried out, whereby the toner concentration inside the developer tank rises. Furthermore, when it is detected that the toner concentration inside the developer tank is higher than the second reference value (that is, the second reference toner concentration), the operation of forcibly consuming the toner inside the developer tank is carried out, whereby the toner concentration inside the developer tank lowers, and the replenishing operation of the replenishment developer is carried out, whereby the lowered volume level inside the developer tank rises.

The replenishment amount of the replenishment developer at the time when it is detected that the toner concentration inside the developer tank is higher than the second reference value is made larger than the forced consumption amount of the toner inside the developer tank, whereby the lowered volume level inside the developer tank rises.

The operation of forcibly consuming the toner inside the developer tank is done by attaching the toner inside the developer tank to the electrostatic latent image holder. Since such a component incorporated in the image forming apparatus is used as described above, it not necessary to additionally install any toner consumption mechanism for forcibly consuming the toner, and the cost does not increase.

The control unit is characterized in that when it is detected that the toner concentration inside the developer tank is higher than the second reference value, the control unit carries out the operation of forcibly consuming the toner inside the developer tank until it is detected that the toner concentration inside the developer tank is lower than the first reference value and that after it is detected that the toner concentration inside the developer tank is lower than the first reference value, the control unit carries out the operation of forcibly consuming the toner inside the developer tank and the replenishment operation of the replenishment developer concurrently. With the above-mentioned control unit, the operation of forcibly consuming the toner inside the developer tank is carried out until it is detected that the toner concentration inside the developer tank is lower than the first reference value, whereby the toner concentration inside the developer tank lowers to the first reference value. After the toner concentration inside the developer tank becomes lower than the first reference value, the operation of forcibly consuming the toner inside the developer tank and the replenishment operation of the replenishment developer are carried out concurrently, whereby the lowered volume level inside the developer tank rises while the toner concentration inside the developer is maintained approximately at the first reference value. The invention set forth above corresponds to a first toner forced consumption mode described later.

The control unit is characterized in that when it is detected that the toner concentration inside the developer tank is higher than the second reference value, the control unit carries out the operation of forcibly consuming the toner inside the developer tank a predetermined number of times, and that the control unit carries out the operation of forcibly consuming the toner inside the developer tank and the replenishment operation of the replenishment developer concurrently a predetermined number of times, and then that the control unit carries out the operation of forcibly consuming the toner inside the developer tank until it is detected that the toner concentration inside the developer tank is lower than the second reference value. With the above-mentioned control unit, the operation of forcibly consuming the toner inside the developer tank is carried out the predetermined number of times, whereby the raised toner concentration inside the developer tank lowers to some extent. Furthermore, the operation of forcibly consuming the toner inside the developer tank and the replenishment operation of the replenishment developer are carried out the predetermined number of times in the state that the toner concentration inside the developer tank has lowered to some extent, whereby the volume level inside the developer tank gradually rises. Still further, the operation of forcibly consuming the toner inside the developer tank is carried out until the toner concentration inside the developer tank becomes lower than the second reference value, whereby the raised toner concentration lowers to the second reference value, and the volume level rises to a predetermined height. Hence, the replenishment developer is replenished at an early stage before the toner concentration inside the developer tank reaches the first reference value (that is, after the operation of forcibly consuming the toner is carried out the predetermined number of times), whereby the lowering of the toner concentration and the rising of the volume level inside the developer tank can be attained in shorter times. The invention set forth above corresponds to a second toner forced consumption mode described later.

The developing device is characterized in that the developing device further comprises a developer discharge detecting sensor for detecting whether the developer-tank-contained developer is discharged from the discharging mechanism and that when it is detected that the toner concentration inside the developer tank is higher than the second reference value, the control unit carries out the operation of forcibly consuming the toner inside the developer tank and the replenishment operation of the replenishment developer concurrently until the discharge of the developer-tank-contained developer is detected. With the above-mentioned developing device, the operation of forcibly consuming the toner and the replenishment operation of the replenishment developer are carried out concurrently until the discharge of the developer-tank-contained developer is actually detected using the developer discharge detecting sensor, whereby the volume level inside the developer tank gradually rises until the developer-tank-contained developer inside the developer tank is discharged using the discharging mechanism while the toner concentration is maintained at the first reference value. The invention set forth above corresponds to a third toner forced consumption mode described later.

The above-mentioned developing device is incorporated and used in an image forming apparatus comprising a rotatable electrostatic latent image holder for holding electrostatic latent images on the circumferential face thereof, stirring members for stirring a developer-tank-contained developer containing toner and carrier inside a developer tank while conveying the developer, and a developer holder disposed adjacent to the stirring members to supply the stirred developer-tank-contained developer to the electrostatic latent image holder.

Since paper is wastefully consumed when ordinary image formation in which paper output is performed for the forced consumption operation of the toner inside the developer tank is carried out, the image forming apparatus further comprises transfer unit for transferring a toner image developed into a visible image using the developer holder onto paper from the circumferential face of the electrostatic latent image holder and cleaning device for removing nontransferred toner from the surface of the electrostatic latent image holder, whereby forcibly consumed toner is not transferred onto the paper but is recovered using the cleaning device.

DESCRIPTION OF THE PREFERRED EMBODIMENT

Figure 1:
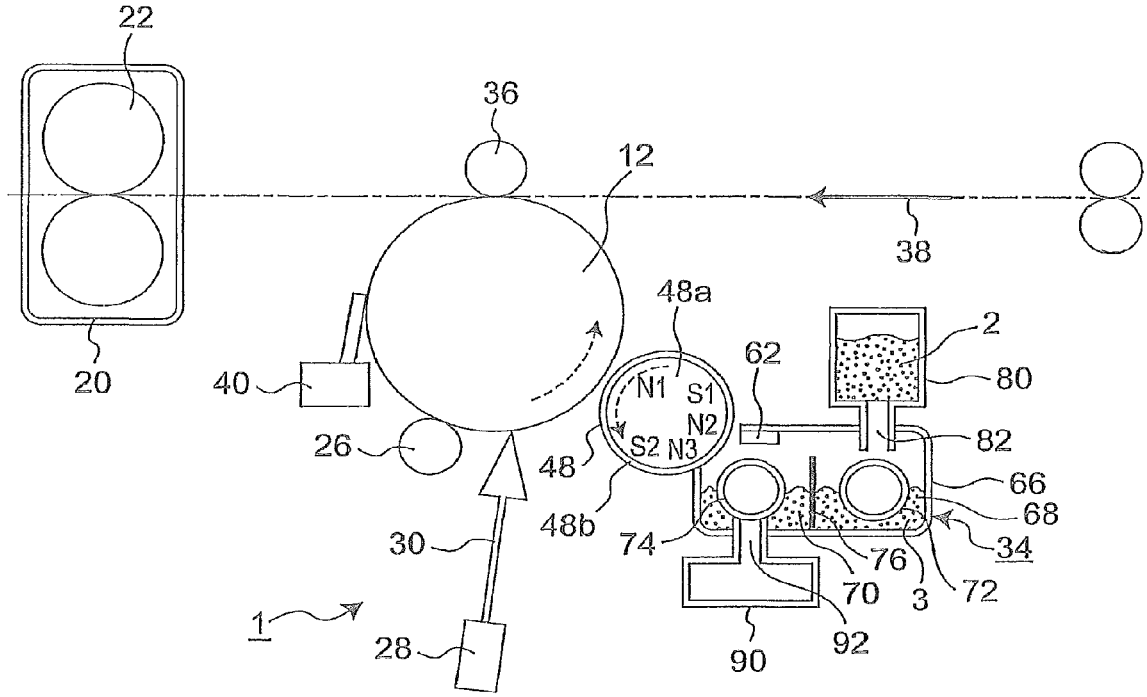
FIG. 1 is a view showing the schematic configuration of an image forming apparatus according to a first embodiment of the present invention.

Preferred embodiments according to the present invention will be described below referring to the accompanying drawings. Although terms meaning specific directions (for example, "above," "below," "left" and "right" and other terms including these, and "clockwise" and "counterclockwise") are used in the following description, they are used for purposes of facilitating the understanding of the present invention referring to the drawings, and it should not be construed that the present invention is limited by the meanings of the terms. Furthermore, in an image forming apparatus 1 and a developing device 34 described below, identical or similar components are designated by the same reference numerals.

The image forming apparatus 1 and the developing device 34 incorporated therein according to a first embodiment of the present invention will be described referring to FIGS. 1 to 3.

[Image Forming Apparatus]

FIG. 1 shows the components relating to image formation in the electrophotographic image forming apparatus 1 according to the present invention. The image forming apparatus 1 may be a copier, a printer, a facsimile machine or a compound machine combinedly equipped with the functions of these. The image forming apparatus 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing device 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing device 34 develops the electrostatic latent image into a visible image using a developer-tank-contained developer 3 described later. The details of the developing device 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 1, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming apparatus 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing device 34 and developed into a visible image using the developing device 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

[Developing Device]

The developing device 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 12 (counter direction).

Figure 2:
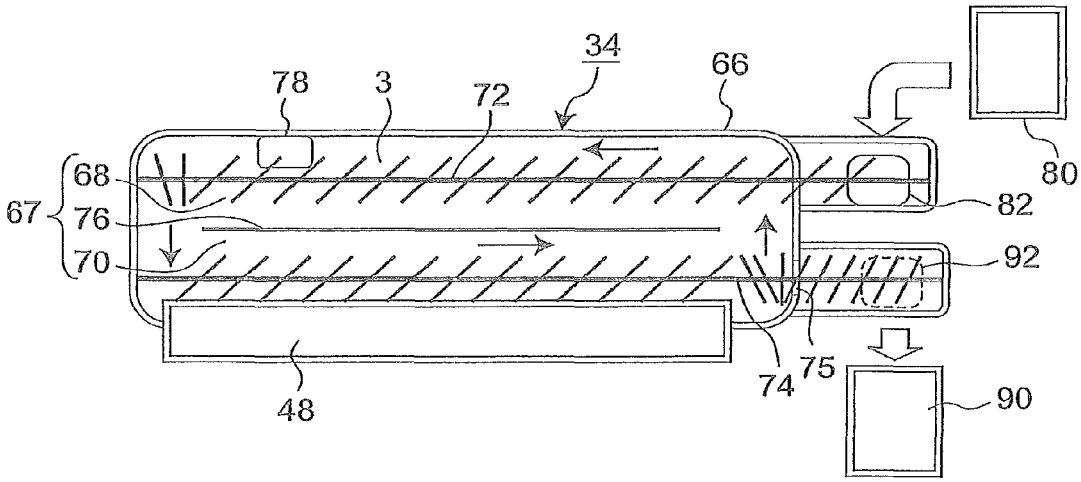
FIG. 2 is a schematic sectional view showing the developing device of the image forming apparatus shown in FIG. 1 as seen from above.

FIG. 2 is a schematic sectional view showing the developing device 34 as seen from above. As shown in FIG. 2, a developer stirring and conveying chamber 67 is formed behind the developing roller 48. The developer stirring and conveying chamber 67 comprises a second conveying passage 70 formed near the developing roller 48, a first conveying passage 68 formed away from the developing roller 48 and a partition wall 76 for partitioning the space between the first conveying passage 68 and the second conveying passage 70. Above the upstream side of the conveying direction of the first conveying passage 68, a developer replenishing tank 80 is disposed and communicates with the first conveying passage 68 via a replenishing port 82. The developer replenishing tank 80 is filled with a replenishment developer 2 containing toner as a major ingredient and carrier. The ratio of the carrier in the replenishment developer 2 is preferably 5 to 40 wt %, further preferably 10 to 30 wt %. In addition, below the downstream side of the conveying direction of the second conveying passage 70, a developer recovery tank 90 is disposed and communicates with the second conveying passage 70 via a recovery port 92.

At the bottom of the developer replenishing tank 80, a developer supplying roller is disposed, the driving operation of which is controlled using a controller 100. When the developer supplying roller is driven and rotated, the replenishment developer 2, which is fresh and the amount of which corresponds to the driving time of the roller, flows downward and is supplied to the first conveying passage 68 of the developer tank 66.

In the first conveying passage 68, a first screw 72 serving as a stirring member for conveying the developer-tank-contained developer 3 while stirring the developer is rotatably supported. In the second conveying passage 70, a second screw 74 for conveying the developer-tank-contained developer 3 from the first conveying passage 68 to the developing roller 48 while stirring the developer is rotatably supported. In this case, the upper portions of the partition wall 76 located at both end sections of the first conveying passage 68 and the second conveying passage 70 are cut out, and communicating passages are formed. The developer-tank-contained developer 3 having reached the end section on the downstream side in the conveying direction of the first conveying passage 68 is sent into the second conveying passage 70 via the communicating passage, and the developer-tank-contained developer 3 having reached the end section on the downstream side in the conveying direction of the second conveying passage 70 is sent into the first conveying passage 68 via the communicating passage. As a result, the developer-tank-contained developer 3 is circulated inside the developer stirring and conveying chamber in the direction indicated by the arrows shown in FIG. 2.

Figure 8:
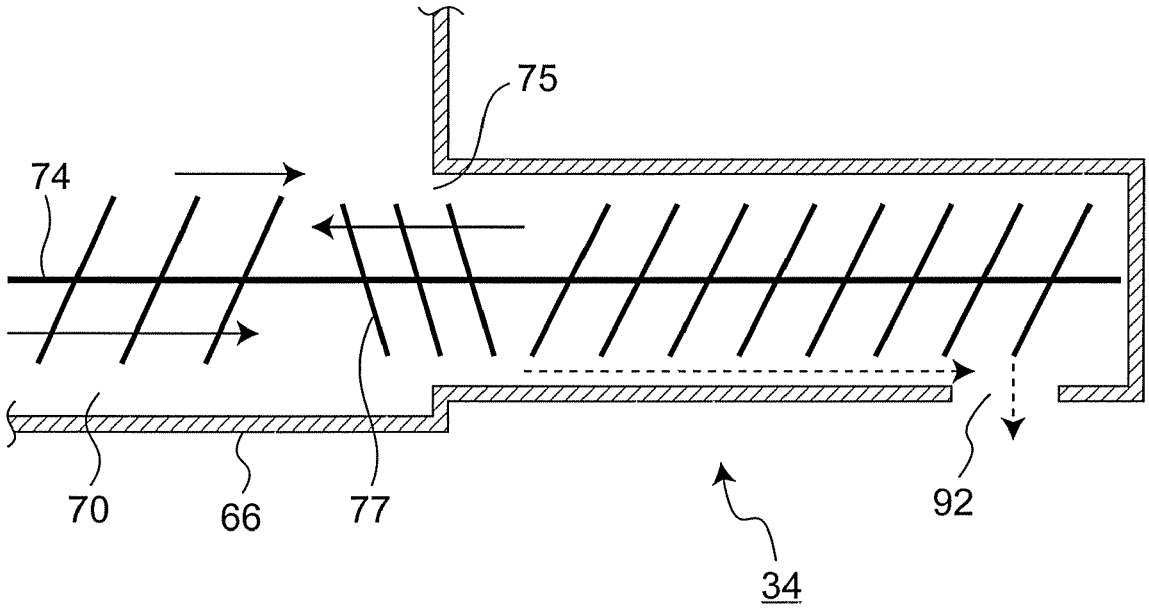
FIG. 8 is a schematic sectional view showing part of the developing device of the image forming apparatus shown in FIG. 1 as seen from the side.

The first screw 72 and the second screw 74 are each a spiral screw in which a spiral vane with a predetermined pitch is secured to a shaft. FIG. 8 is a schematic sectional view showing part of the developing device 34 as seen from the side and corresponding to the right end section shown in FIG. 2. As shown in FIG. 8, the second screw 74 is extended rightward in the figure and further extended above the recovery port 92. At each of the positions corresponding to the communicating passage from the second conveying passage 70 to the first conveying passage 68 and to the downstream side end section of the first conveying passage 68, the second screw 74 has a reverse vane section 77 in which the spiral direction of the spiral screw is opposite to that at the other section. The pitch of the vane of the second screw 74 at the downstream side end section (the right end section in FIG. 2) in the conveying direction is made smaller than that at the other section. As a result, when the second screw 74 is rotated, the level of the developer-tank-contained developer 3 at the downstream side end section (the right end section) in the conveying direction of the second screw 74 becomes higher than that at the other vane section. In other words, a rising of the developer-tank-contained developer 3 is formed at the downstream side end section (the right end section) in the conveying direction of the second screw 74.

Since the developing device 34 employs the so-called trickle system, the developing device has an outlet 75 for allowing an excessive amount of the developer-tank-contained developer 3 to flow out. In other words, the outlet 75 is formed by providing a cutout 75 that is formed by partially cutting out the upper portion of the side wall located at the downstream side end section (the right end section) in the conveying direction of the second conveying passage 70. In a usual state, the developer being conveyed using the second screw 74 is stopped using the reverse vane section 77 and conveyed from the second conveying passage 70 to the first conveying passage 68 as indicated by the solid-line arrows shown in FIGS. 2 and 8. When the developer-tank-contained developer 3 increases inside the developer tank and the developer level inside the developer tank rises, the developer-tank-contained developer 3 climbs over the outlet 75 disposed at the upper portion of the side wall against the damming action of the reverse vane section 77 and overflows to a recovery chamber adjacent thereto. The excessive amount of the developer-tank-contained developer 3 overflowed to the recovery chamber is conveyed to the recovery port 92 in the directions indicated by the broken-line arrows shown in FIG. 8 and recovered (dumped) into the developer recovery tank 90 via the recovery port 92.

In the developer stirring and conveying chamber 67, a toner concentration detecting sensor 78 for detecting the toner concentration inside the developer stirring and conveying chamber 67 is provided. The toner concentration detecting sensor 78 detects the permeability of the developer-tank-contained developer 3 being conveyed inside the developer stirring and conveying chamber 67 on the basis of the change in the inductance of a coil, for example. The ratio of the toner in the developer-tank-contained developer 3 is obtained on the basis of the permeability detected using the toner concentration detecting sensor 78. For example, when the amount of the carrier contained in the developer-tank-contained developer 3 is small, it is detected that the ratio of the toner is high. On the other hand, when the amount of the carrier contained in the developer-tank-contained developer 3 is large, it is detected that the ratio of the toner is low. In addition, the voltage signal output from the toner concentration detecting sensor 78 is input to the controller 100, a required replenishing amount is calculated on the basis of the detection signal, the developer replenishing roller of the developer replenishing tank 80 is driven, and the predetermined amount of the replenishment developer 2 is replenished into the developer tank 66.

In the developing device 34, when the toner concentration of the circulating developer-tank-contained developer 3 lowers as the printing operation proceeds, the replenishment developer 2 containing toner and a small amount of carrier is replenished from the developer replenishing tank 80. The replenishment developer 2 having been replenished is conveyed along the first conveying passage 68 and the second conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing device 34, and the charging performance of the carrier lowers gradually. Since a small amount of the carrier that is bulkier than the toner is contained in the replenishment developer 2, as the replenishment developer 2 is replenished, the amount of the developer-tank-contained developer 3 gradually increases inside the developing device 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse vane section 77 and flows out from the outlet 75 provided at the downstream side end section (the right end section) in the conveying direction of the second conveying passage 70 and is recovered in the developer recovery tank 90 via the recovery port 92. A developer discharge detecting sensor 112 is provided in the recovery port 92 or the developer stirring and conveying chamber 67. The developer discharge detecting sensor 112 comprises, for example, a light-emitting device, such as an infrared LED, and a light-receiving device for receiving the light from the light-receiving device. The discharge of the excessive amount of the developer-tank-contained developer 3 is detected when the light-receiving device detects that the light from the light-emitting device is interrupted by the developer.

The replenishing amount of the replenishment developer 2 is determined on the basis of the toner concentration of the developer-tank-contained developer 3 detected using the toner concentration detecting sensor 78, the image information (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing device 34 is suppressed from deteriorating and that the cost is not increased. As the toner replenishing operation proceeds, the carrier is supplied gradually.

Figure 3:
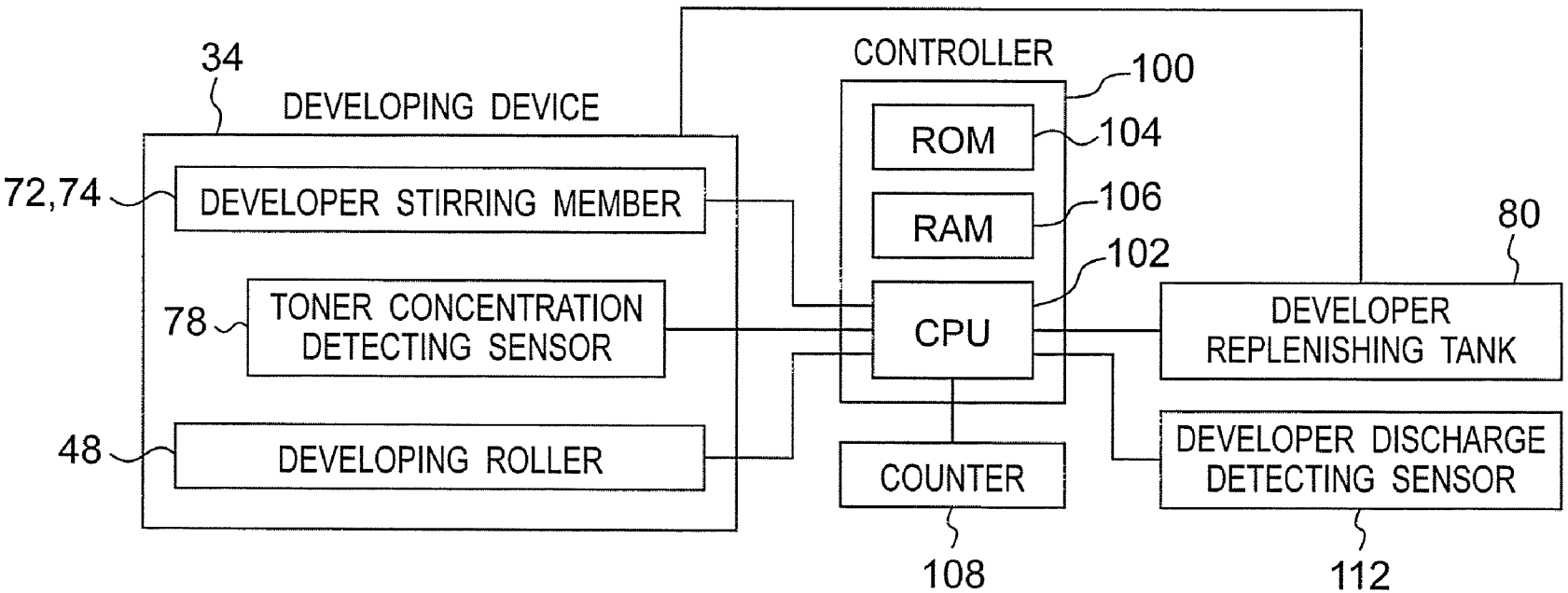
FIG. 3 is a block diagram of the developing device of the image forming apparatus shown in FIG. 2.

FIG. 3 is a control block diagram of the developing device 34 of the image forming apparatus 1.

The controller 100 serving as control unit comprises a CPU (central processing unit) 102, a ROM (read only memory) 104, a RAM (random access memory) 106, etc. The CPU 102 concentratedly controls various operations in the image forming apparatus 1 according to various processing programs and tables stored inside the ROM 104. In the ROM 104, for example, a toner concentration calculation table for carrying out calculation to convert the voltage detected using the toner concentration detecting sensor 78 into the toner concentration of the developer-tank-contained developer 3 and a developer replenishing table for calculating the amount of the developer to be replenished on the basis of the difference between the actual toner concentration of the developer-tank-contained developer 3 and the first reference toner concentration (that is, the first reference value). The RAM 106 provides a work area in which various programs to be executed by the controller 100 and data for the programs are temporarily stored.

The developing device 34, the developer replenishing tank 80, the developer discharge detecting sensor 112 and a counter 108 are connected to the controller 100. The operations of the developer stirring members 72 and 74, the toner concentration detecting sensor 78 and the developing roller 48 constituting the developing device 34 are controlled using the CPU 102 of the controller 100. In addition, the toner concentration of the developer-tank-contained developer 3 detected using the toner concentration detecting sensor 78, image information at the time of image formation, the ratio of the carrier in the replenishment developer 2 inside the developer replenishing tank 80, etc. are temporarily stored in the RAM 106.

[Developer]

The two-component developer contains toner and carrier for charging the toner. In the present invention, the known toner that has been used generally and conventionally can be used for the image forming apparatus 1. The particle diameter of the toner is, for example, approximately 3 to 15 μm. It is also possible to use toner containing a coloring agent in a binder resin, toner containing a charge control agent and a releasing agent, and toner holding additives on the surface.

The toner is produced using known methods, such as the grinding method, the emulsion polymerization method and the suspension polymerization method.

Examples of the binder resin being used for the toner include styrene resins (homopolymers or copolymers containing styrene or styrene substitutes), polyester resins, epoxy resins, polyvinyl chloride resins, phenol resins, polyethylene resins, polypropylene resins, polyurethane resins, silicone resins or any appropriate combinations of these resins, although not restricted to these. The softening temperature of the binder resin is preferably in the range of approximately 80 to 160° C., and the glass transition temperature thereof is preferably in the range of approximately 50 to 75° C.

As the coloring agent, it is possible to use known materials, such as carbon black, aniline black, activated charcoal, magnetite, benzine yellow, permanent yellow, naphthol yellow, phthalocyanine blue, fast sky blue, ultramarine blue, rose bengal and lake red. In general, the additive amount of the coloring agent is preferably 2 to 20 parts by weight per 100 parts by weight of the binder resin.

The materials conventionally known as charge control agents can be used as the charging control agent. More specifically, for the toner that is positively charged, it is possible to use materials, such as nigrosin dyes, quaternary ammonium salt compounds, triphenylmethane compounds, imidazole compounds and polyamine resins, as the charge control agent. For the toner that is negatively charged, it is possible to use materials, such as azo dyes containing metals such as Cr, Co, Al and Fe, salicylic acid metal compounds, alkyl salicylic acid metal compounds and calixarene compounds, as the charge control agent. It is desirable that the charge control agent is used in the ratio of 0.1 to 10 parts by weight per 100 parts by weight of the binder resin.

The materials conventionally known and used as releasing agents can be used as the releasing agent. As the material of the releasing agent, it is possible to use materials, such as polyethylene, polypropylene, carnauba wax, sasol wax or any appropriate combinations of these. It is desirable that the releasing agent is used in the ratio of 0.1 to 10 parts by weight per 100 parts by weight of the binder resin.

Furthermore, it may be possible to add a fluidizer for accelerating the fluidization of the developer. As the fluidizer, it is possible to use inorganic particles, such as silica, titanium oxide and aluminum oxide, and resin particles, such as acrylic resins, styrene resins, silicone resins and fluororesins. It is particularly desirable to use materials hydrophobized using a silane coupling agent, a titanium coupling agent, silicone oil, etc. It is desirable that the fluidizer is added in the ratio of 0.1 to 5 parts by weight per 100 parts by weight of the toner. It is desirable that the number average primary particle diameters of these additives are in the range of 9 to 100 nm.

As the carrier, the known carriers used conventionally and generally can be used. Either the binder-type carrier or the coated-type carrier may be used. It is desirable that the diameter of the carrier particles is in the range of approximately 15 to 100 μm, although not restricted to this range.

The binder-type carrier is that obtained by dispersing magnetic particles in a binder resin and it is possible to use carrier having positively or negatively charged particles or a coating layer on its surface. The charging characteristics, such as polarity, of the binder-type carrier can be controlled depending on the material of the binder resin, electrostatic charging particles and the kind of the surface coating layer.

Examples of the binder resin being used for the binder-type carrier include thermoplastic resins, such as vinyl resins typified by polystyrene resins, polyester resins, nylon resins and polyolefin resins, and thermosetting resins, such as phenol resins.

As the magnetic particles of the binder-type carrier, it is possible to use spinel ferrites, such as magnetite and gamma ferric oxide; spinel ferrites containing one or more kinds of nonferrous metals (such as Mn, Ni, Mg and Cu); magnetoplumbite ferrites, such as barium ferrite; and iron or alloy particles having oxide layers on the surfaces. The shape of the carrier may be particulate, spherical or needle-like. In particular, when high magnetization is required, it is desirable to use iron-based ferromagnetic particles. In consideration of chemical stability, it is desirable to use ferromagnetic particles of spinel ferrites, such as magnetite and gamma ferric oxide, or magnetoplumbite ferrites, such as barium ferrite. It is possible to obtain magnetic resin carrier having the desired magnetization by appropriately selecting the kind and content of the ferromagnetic particles. It is appropriate to add 50 to 90 wt % of the magnetic particles to the magnetic resin carrier.

As the surface coating material of the binder-type carrier, it is possible to use silicone resins, acrylic resins, epoxy resins, fluororesins, etc. The charging capability of the carrier can be enhanced by coating the surface of the carrier with this kind of resin and by thermosetting the resin.

The fixation of electrostatic charging particles or electrically conductive particles to the surface of the binder-type carrier is carried out according to, for example, a method in which the magnetic resin carrier is uniformly mixed with the particles, the particles are attached to the surface of the magnetic resin carrier, and then mechanical and thermal impact forces are applied to the particles to put the particles into the magnetic resin carrier. In this case, the particles are not completely embedded into the magnetic resin carrier but fixed such that parts thereof protrude from the surface of the magnetic resin carrier. As the electrostatic charging particles, organic or inorganic insulating materials are used. More specifically, as organic insulating materials, organic insulating particles, such as polystyrene, styrene copolymers, acrylic resins, various acrylic copolymers, nylon, polyethylene, polypropylene, fluororesins and cross-linked materials of these are available. The charging capability and the charging polarity thereof can be adjusted so as to be suited for the material of the electrostatic charging particles, polymerization catalyst, surface treatment, etc. As the inorganic insulating material, negatively charged inorganic particles, such as silica and titanium dioxide, and positively charged inorganic particles, such as strontium titanate and alumina, are used.

The coated-type carrier is carrier obtained by coating carrier core particles made of a magnetic substance with a resin, and electrostatic charging particles charged positively or negatively can be fixed to the surface of the carrier, as in the case of the binder-type carrier. The charging characteristics, such as polarity, of the coated-type carrier can be adjusted by selecting the kind of the surface coating layer and the electrostatic charging particles. As the coating resin, it is possible to use resins similar to the binder resins for the binder-type carrier.

The mixture ratio of the toner and the carrier of the developer-tank-contained developer 3 is adjusted such that a desired toner charging amount is obtained. The ratio of the toner in the developer-tank-contained developer 3 is preferably 3 to 20 wt % and further preferably 4 to 15 wt % with respect to the total amount of the toner and the carrier. In addition, the replenishment developer 2 stored in the developer replenishing tank 80 contains toner and a small amount of carrier, and the ratio of the carrier in the replenishment developer 2 is preferably 1 to 50 wt % and further preferably 5 to 30 wt %.

The operation of the developing device 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed between the first conveying passage 68 and the second conveying passage 70. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer-tank-contained developer 3 charged as described above is supplied to the developing roller 48 in the process of being conveyed to the second conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the second conveying passage 70 of the developer tank 66, and then recovered into the developer tank 66. The recovered developer is mixed with the developer-tank-contained developer 3 that is being conveyed to the second conveying passage 70.

When the toner contained in the developer-tank-contained developer 3 is forcibly consumed by the image formation described above, it is desirable that the amount of the toner corresponding to the consumed amount is replenished to the developer-tank-contained developer 3. For this purpose, the developing device 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the first conveying passage 68.

The image formation according to the present invention is broadly classified into ordinary image formation in which paper output is performed after development and the so-called patch image formation in which paper output is not performed after development. The patch image formation means image formation in which an electrostatic latent image in a solid state is formed on the photosensitive member 12 by keeping the radiation state of the image light 30 of the exposure device 28 at a predetermined amount of light without switching the image light 30 of the exposure device 28 between the radiation and nonradiation state on the basis of image data. By the development of the electrostatic latent image in the solid state, toner is forcibly attached onto the photosensitive member 12, and the forcibly attached toner is recovered using the cleaning device 40 without being transferred onto the paper 38, whereby the toner is forcibly consumed. Since the paper 38 is wastefully consumed if ordinary image formation is carried out for the forced consumption of toner, patch image formation is used for the forced consumption of toner in the present invention. Furthermore, for the purpose that toner is consumed as much as possible by one patch image formation operation at the time of the forced consumption of toner, it is desirable that the area of the photosensitive member 12 radiated with the image light 30 is as wide as possible in the patch image formation.

Next, the operation of the developing device 34 according to the first embodiment will be described referring to FIGS. 4 and 5.

Figure 4:
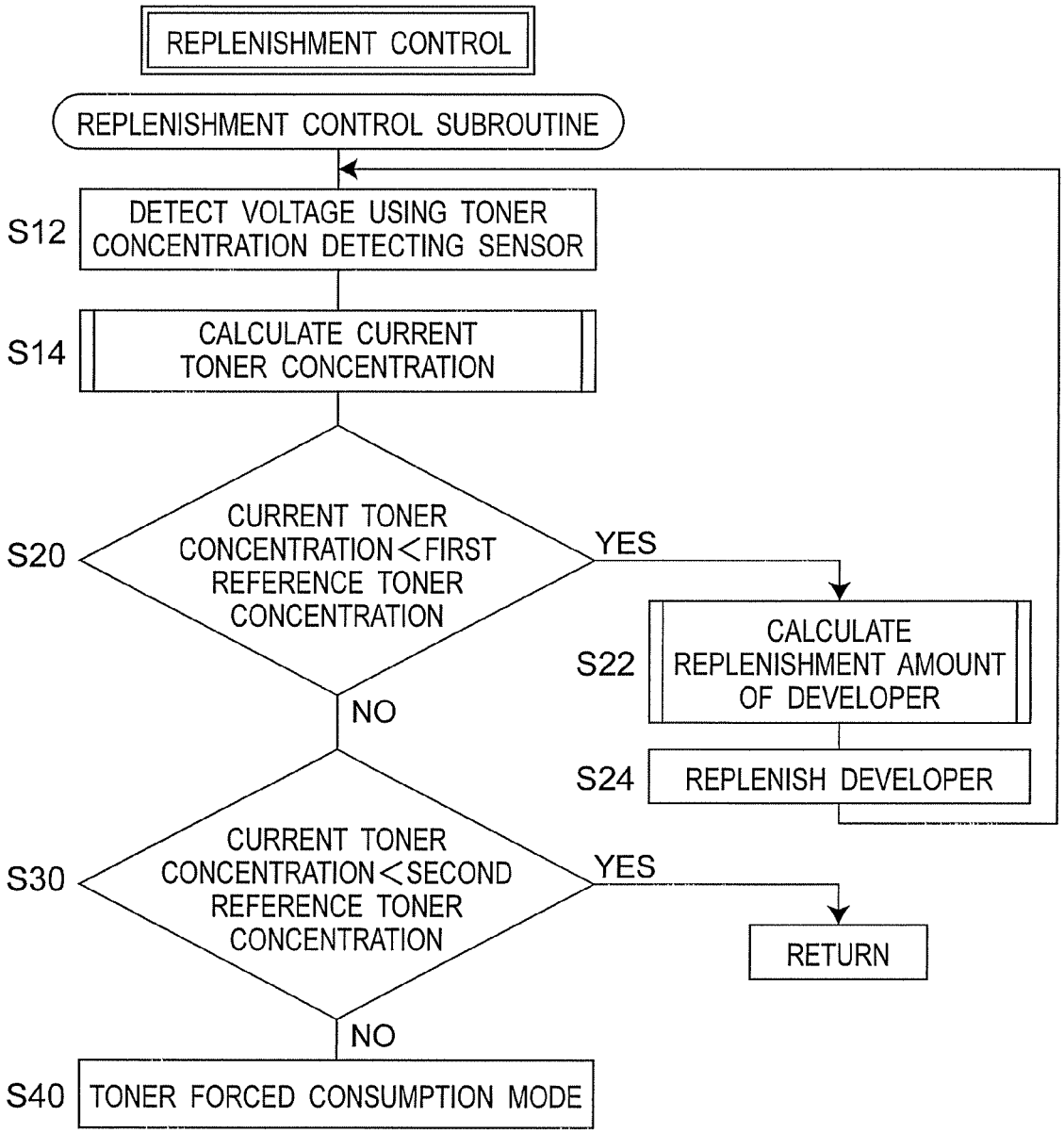
FIG. 4 is a flowchart of a subroutine regarding the replenishment operation of the developing device according to the first embodiment of the present invention.

FIG. 4 is a main flowchart showing the replenishment operation for the developing device 34 according to the first embodiment of the present invention. FIG. 5 is a flowchart in a first toner forced consumption mode according to the first embodiment. Although the description is given while the following specific numeric values are used to facilitate the understanding of the first toner forced consumption mode according to the first embodiment, the numeric values are only examples, and this embodiment is not restricted by the numeric values.

The first reference toner concentration (that is, the first reference value) of the developer-tank-contained developer 3 stored in the trickle developing device 34 is 7 wt %, and its amount is approximately 250 g. When it is assumed that the second reference toner concentration (that is, the second reference value) of the developer-tank-contained developer 3 inside the developing device 34 is the first reference toner forced consumption (7 wt %)+2 wt %, the second reference toner concentration is 9 wt %. The amount of the developer stored inside the developing device 34 at the second reference toner concentration (9 wt %) is approximately 210 g. The amount of the toner to be consumed by one patch image formation operation is approximately 0.5 g. The ratio of the carrier in the replenishment developer 2 is 15 wt %. The replenishment amount of the replenishment developer 2 in one replenishment operation is approximately 0.6 g, corresponding to approximately 0.5 g when converted into the amount of the toner. The number K of replenishment operations for the replenishment developer 2 is 100.

FIG. 4 shows a subroutine regarding the replenishment control for the developing device 34 in the entire control (main routine), not shown. At step S12, a voltage signal regarding the toner concentration of the developer-tank-contained developer 3 existing in the developer stirring and conveying chamber 67 is output from the toner concentration detecting sensor 78. At step S14, the output voltage signal is converted by calculation into the value of the toner concentration using the controller 100. At step S20, a judgment is made as to whether the current toner concentration is lower than the first reference toner concentration (7 wt %). When the current toner concentration is judged to be lower than the first reference toner concentration, at step S22, the replenishment amount of the replenishment developer 2 is calculated on the basis of the current toner concentration detected using the toner concentration detecting sensor 78, the image information (dot counter) at the time of image formation and the ratio of the carrier in the replenishment developer 2 inside the developer replenishing tank 80. Furthermore, at step S24, the predetermined amount of the replenishment developer 2 is replenished and the process returns to step S12 for toner concentration detection.

When the current toner concentration is judged to be equal to or higher than the first reference toner concentration at step S20, a judgment is made at step S30 as to whether the current toner concentration is lower than the second reference toner concentration (9 wt %). When the current toner concentration is judged to be lower than the second reference toner concentration (9 wt %), the subroutine ends, and the process returns to the main routine. When the current toner concentration is judged to be equal to or higher than the second reference toner concentration (9 wt %) due to the measurement accuracy of the toner concentration detecting sensor 78, the filling state of the developer-tank-contained developer 3 around the toner concentration detecting sensor 78 and the changes in the ambient environment of the image forming apparatus, the process shifts to the first toner forced consumption mode at step S40. At this time, the amount of the developer-tank-contained developer 3 stored inside the developing device 34 is approximately 210 g.

Figure 5:
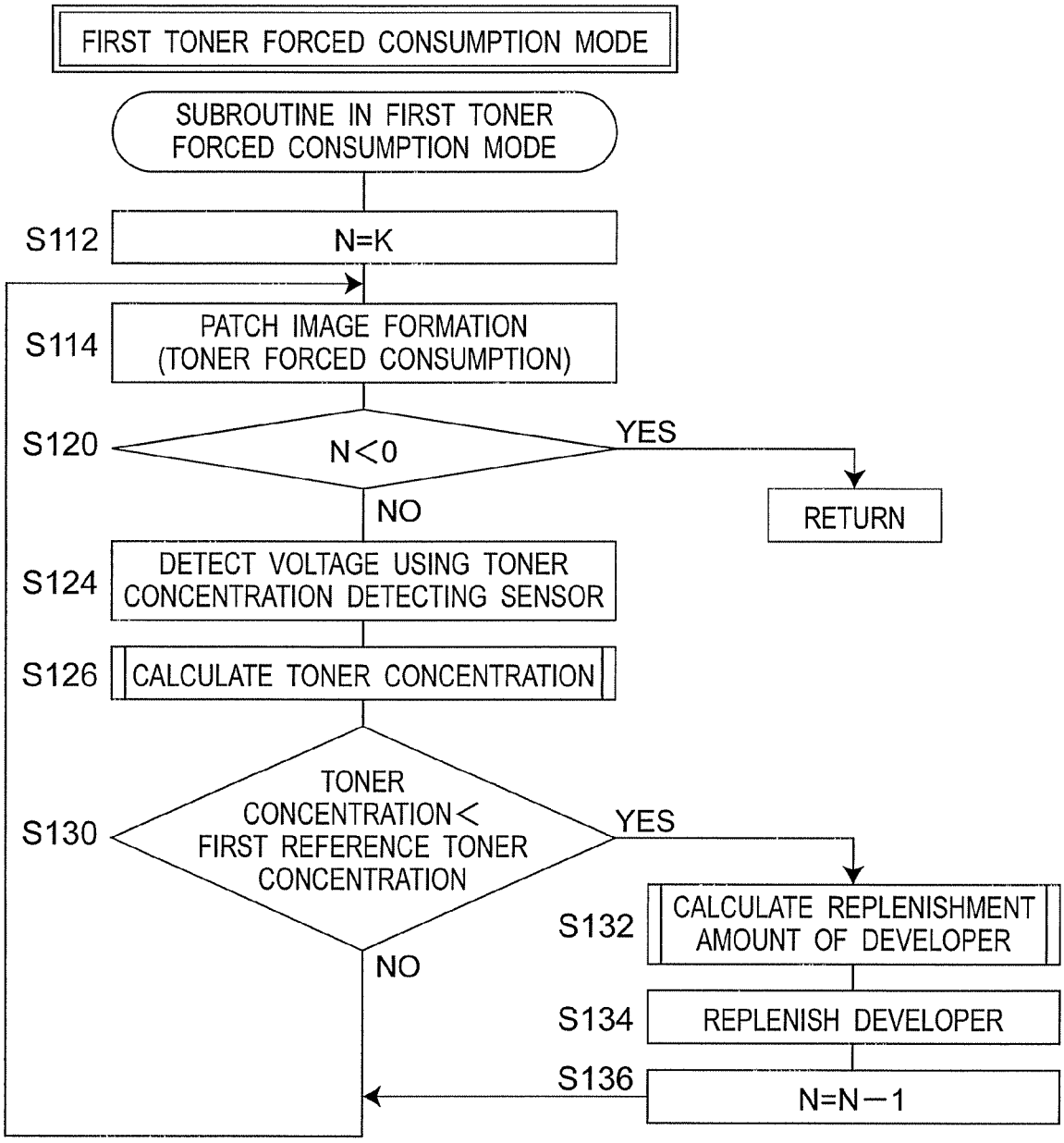
FIG. 5 is a flowchart of a subroutine regarding a first toner forced consumption mode according to the first embodiment.

FIG. 5 shows a subroutine regarding the first toner forced consumption mode of the subroutine regarding the replenishment control for the developing device 34, shown in FIG. 4. At step S112, the number K (100) of replenishment operations, that is, the number of how many times the replenishment developer 2 is replenished is set. At step S114, patch image formation in which paper output is not performed after development is carried out for toner forced consumption operation. In this patch image formation, for the purpose that toner is consumed as much as possible by one patch image formation operation, an image is formed in a solid state so as to cover the almost entire face. Approximately 0.5 g of toner is consumed by one patch image formation operation.

When it is judged that the replenishment is not carried out predetermined number of times (100), at step S124, a voltage signal regarding the toner concentration of the developer-tank-contained developer 3 existing in the developer stirring and conveying chamber 67 is output from the toner concentration detecting sensor 78. At step S126, the output voltage signal is converted by calculation into the value of the toner concentration using the controller 100. At step S130, a judgment is made as to whether the detected current toner concentration of the developer-tank-contained developer 3 is lower than the first reference toner concentration (7 wt %).

At step S130, when the current toner concentration of the developer-tank-contained developer 3 is judged to be equal to or higher than the first reference toner concentration (7 wt %), the process returns to step S114 for patch image formation. In other words, the patch image formation at step S114 is repeated until the current toner concentration becomes lower than the first reference toner concentration (7 wt %). For example, patch image formation is repeated a dozen of times. Since patch image formation is repeated, the toner is consumed, and the toner concentration gradually lowers; however, since the replenishment of the replenishment developer 2 is not carried out, the volume level of the developer-tank-contained developer 3 inside the developer tank 55 lowers.

When it is judged at step S130 that the current toner concentration of the developer-tank-contained developer 3 has become lower than the first reference toner concentration (7 wt %), that is, when it is judged that the current toner concentration of the developer-tank-contained developer 3 is restored to the first reference toner concentration as the result of the repetition of the patch image formation, the replenishment amount of the replenishment developer 2 is calculated at step S132 on the basis of the current toner concentration of the developer-tank-contained developer 3 detected using the toner concentration detecting sensor 78, the image information (dot counter) at the time of image formation and the ratio of the carrier in the replenishment developer 2 inside the developer replenishing tank 80. Furthermore, at step S134, the calculated amount (approximately 0.6 g) of the replenishment developer 2 is replenished, and the number of repetitions of the routine is decreased by one, and the process returns to step S114 for patch image formation. Although the toner is consumed by the patch image formation at step S114, since the replenishment amount (approximately 0.5 g) of the toner is balanced with the consumed amount (approximately 0.5 g), the toner concentration of the developer-tank-contained developer 3 is maintained in the restored state, that is, the first reference toner concentration (7 wt %). As a result, the process goes to YES wherein the judgment at step S130 is made such that the current toner concentration of the developer-tank-contained developer 3 has become substantially lower than the first reference toner concentration (7 wt %). Hence, in addition to the toner consumption operation by the patch image formation at step S114, the replenishment operation of the replenishment developer 2 from step S134 to S136 is repeated. This means that the carrier contained in the replenishment developer 2 is being replenished while the current toner concentration of the developer-tank-contained developer 3 is being restored to the first reference toner concentration (7 wt %), in other words, the volume level of the developer-tank-contained developer 3 inside the developer tank 66 rises gradually as the carrier is replenished.

At step S120, a judgment is made as to whether replenishment is carried out the predetermined number of times (100). When it is judged that replenishment is carried out the predetermined number of times (100), the subroutine regarding the first toner forced consumption mode ends, and the process returns to the subroutine regarding the replenishment control for the developing device 34, shown in FIG. 4.

In the first toner forced consumption mode, during the replenishment operation of the replenishment developer 2, the accuracy in the toner concentration and the volume level of the developer-tank-contained developer 3 is well balanced with the time required for the replenishment.

When general image formation was carried out using the image forming apparatus 1 having the first toner forced consumption mode described above, image loss due to screw irregularity or the like did not occur, and the effect of the first toner forced consumption mode has been verified.

Next, the operation of the developing device 34 according to a second embodiment will be described referring to FIG. 6.

Figure 6:
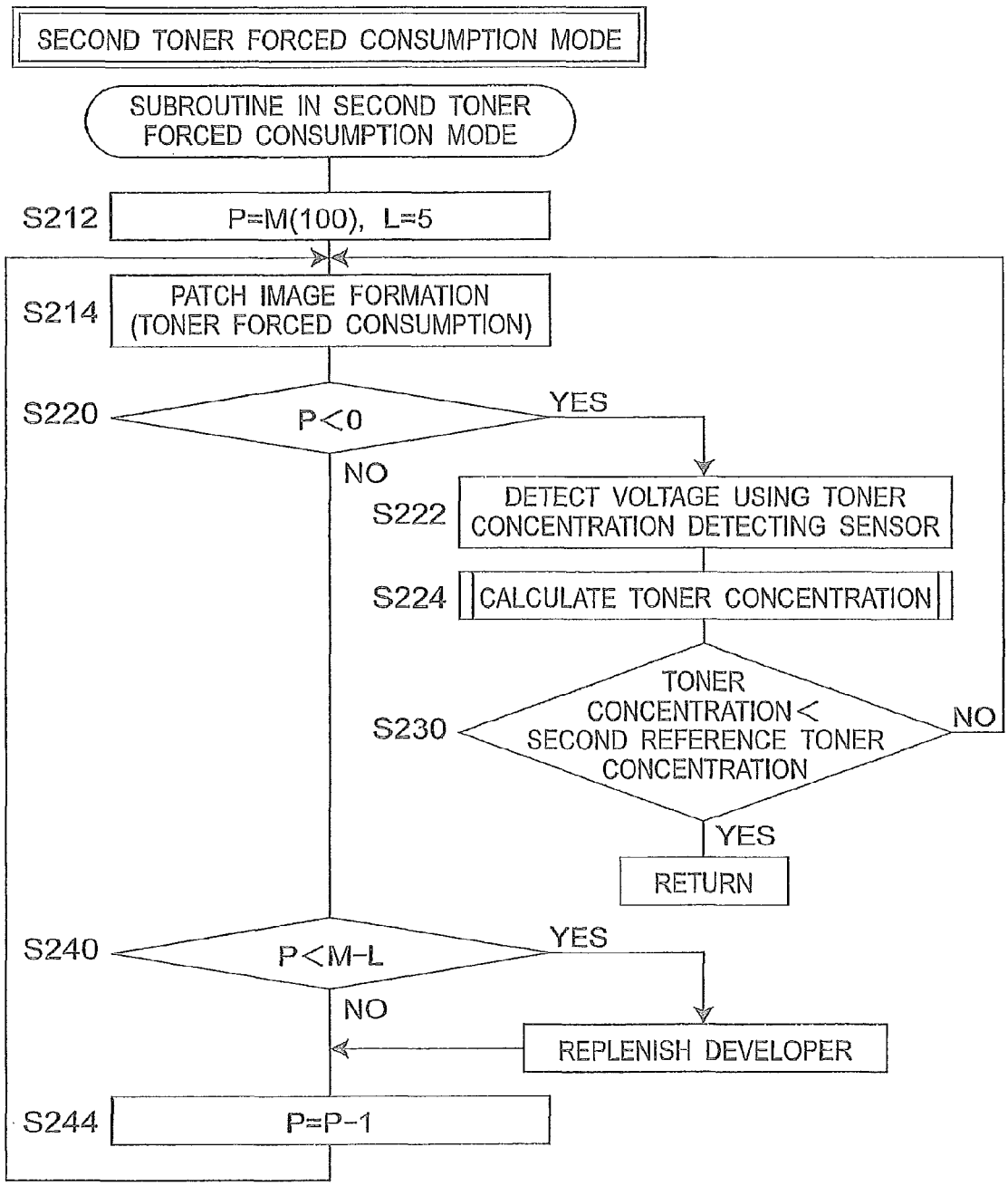
FIG. 6 is a flowchart of a subroutine regarding a second toner forced consumption mode according to a second embodiment.

FIG. 6 is a flowchart of a subroutine regarding a second toner forced consumption mode according to the second embodiment. Although the description is given while the following specific numeric values are used to facilitate the understanding of the second toner forced consumption mode according to the second embodiment, the numeric values are only examples, and this embodiment is not restricted by the numeric values.

The first reference toner concentration of the developer-tank-contained developer 3 stored in the trickle developing device 34 is 7 wt %, and its amount is approximately 250 g. When it is assumed that the second reference toner concentration of the developer-tank-contained developer 3 inside the developing device 34 is the first reference toner forced consumption (7 wt %)+2 wt %, the second reference toner concentration is 9 wt %. The amount of the developer stored inside the developing device 34 at the second reference toner concentration (9 wt %) is approximately 210 g. The amount of toner to be consumed by one patch image formation operation is approximately 0.5 g. The ratio of the carrier in the replenishment developer 2 is 15 wt %. The replenishment amount of the replenishment developer 2 is approximately 0.6 g in one replenishment operation, corresponding to approximately 0.5 g when converted into the amount of the toner. The number M of image formation operations is 100. The number L of times before the start of replenishment is 5.

In the second embodiment, since the subroutine regarding the replenishment control for the developing device 34 is the same as that for the above-mentioned first embodiment, the description thereof is omitted, and only the subroutine regarding the second toner forced consumption mode, different from that of the first embodiment, will be described.

FIG. 6 shows a subroutine regarding the second toner forced consumption mode of the subroutine regarding the replenishment control for the developing device 34, shown in FIG. 4. At step S212, the number M (100) of image formation operations, that is, the number of how many times image formation operation is carried out, is set; furthermore, the number L (for example, 5) of times before the start of replenishment, that is, the number of how many times image formation is carried out before the start of replenishment, is set. At step S214, patch image formation in which paper output is not performed after development is carried out for toner forced consumption operation. In this patch image formation, for the purpose that toner is consumed as much as possible by one patch image formation operation, an image is formed in a solid state so as to cover the almost entire face. Approximately 0.5 g of toner is consumed by one patch image formation operation. At step S220, a judgment is made as to whether image formation is carried out the number of predetermined times (100).

When it is judged at step S220 that image formation is not carried out the predetermined number of times (100), the process advances to step S240, image formation is carried out a predetermined number of times, and a judgment is made as to whether the number of predetermined times has reached the predetermined number of times before the start of replenishment (100−5=95). When it is judged at step S240 that the number of predetermined times has not reached the predetermined number of times before the start of replenishment, the number of repetitions of the routine is decreased by one, and the process returns to step S214 for patch image formation. According to the setting condition described above, since the number of times before the start of replenishment is reached after image formation is repeated 5 times, it is judged at step S240 that the predetermined number of times before the start of replenishment has been reached.

When it is judged at step S240 that the predetermined number of times before the start of replenishment has been repeated, the predetermined amount (approximately 0.6 g) of the replenishment developer 2 is replenished. Then, at step S244, the number of repetitions of the routine is decreased by one, and the process returns to step S214 for patch image formation. Although the toner is consumed by the patch image formation at step S214, since the replenishment amount (approximately 0.5 g) of the toner is balanced with the consumed amount (approximately 0.5 g), the toner concentration of the developer-tank-contained developer 3 is maintained in a state decreased by the amount approximately corresponding to the five times of image formation operations.

After image formation is carried out 100 times in total, it is judged at step S220 that image formation has been carried out the predetermined number of times, and at step S222, a voltage signal regarding the toner concentration of the developer-tank-contained developer 3 existing in the developer stirring and conveying chamber 67 is output from the toner concentration detecting sensor 78. At step S224, the output voltage signal is converted by calculation into the value of the toner concentration of the developer-tank-contained developer 3 using the controller 100. At step S230, a judgment is made as to whether the detected current toner concentration of the developer-tank-contained developer 3 is lower than the second reference toner concentration (9 wt %).

At step S230, when the current toner concentration of the developer-tank-contained developer 3 is judged to be equal to or higher than the second reference toner concentration (9 wt %), the process returns to step S214 for patch image formation. In other words, the patch image formation at step S214 is repeated until the current toner concentration of the developer-tank-contained developer 3 becomes lower than the second reference toner concentration (9 wt %). Since patch image formation is repeated, toner is consumed, and the toner concentration of the developer-tank-contained developer 3 gradually lowers; however, since the replenishment of the replenishment developer 2 is not carried out, the volume level of the developer-tank-contained developer 3 inside the developer tank 55 lowers.

When it is judged at step S230 that the current toner concentration of the developer-tank-contained developer 3 is lower than the second reference toner concentration (9 wt %), the subroutine regarding the second toner forced consumption mode ends, and the process returns to the subroutine regarding the replenishment control for the developing device 34, shown in FIG. 4.

In the second toner forced consumption mode, since the toner concentration of the developer-tank-contained developer 3 is stipulated by the second reference toner concentration and the volume level of the developer-tank-contained developer 3 is stipulated by the number of times before the start of replenishment, it is characterized in that the time required for the replenishment of the replenishment developer 2 can be reduced remarkably although the accuracy in the toner concentration and the volume level of the developer-tank-contained developer 3 becomes low.

When general image formation was carried out using the image forming apparatus 1 having the second toner forced consumption mode described above, image loss due to screw irregularity or the like did not occur, and the effect of the second toner forced consumption mode has been verified.

Next, the operation of the developing device 34 according to a third embodiment will be described referring to FIG. 7.

Figure 7:
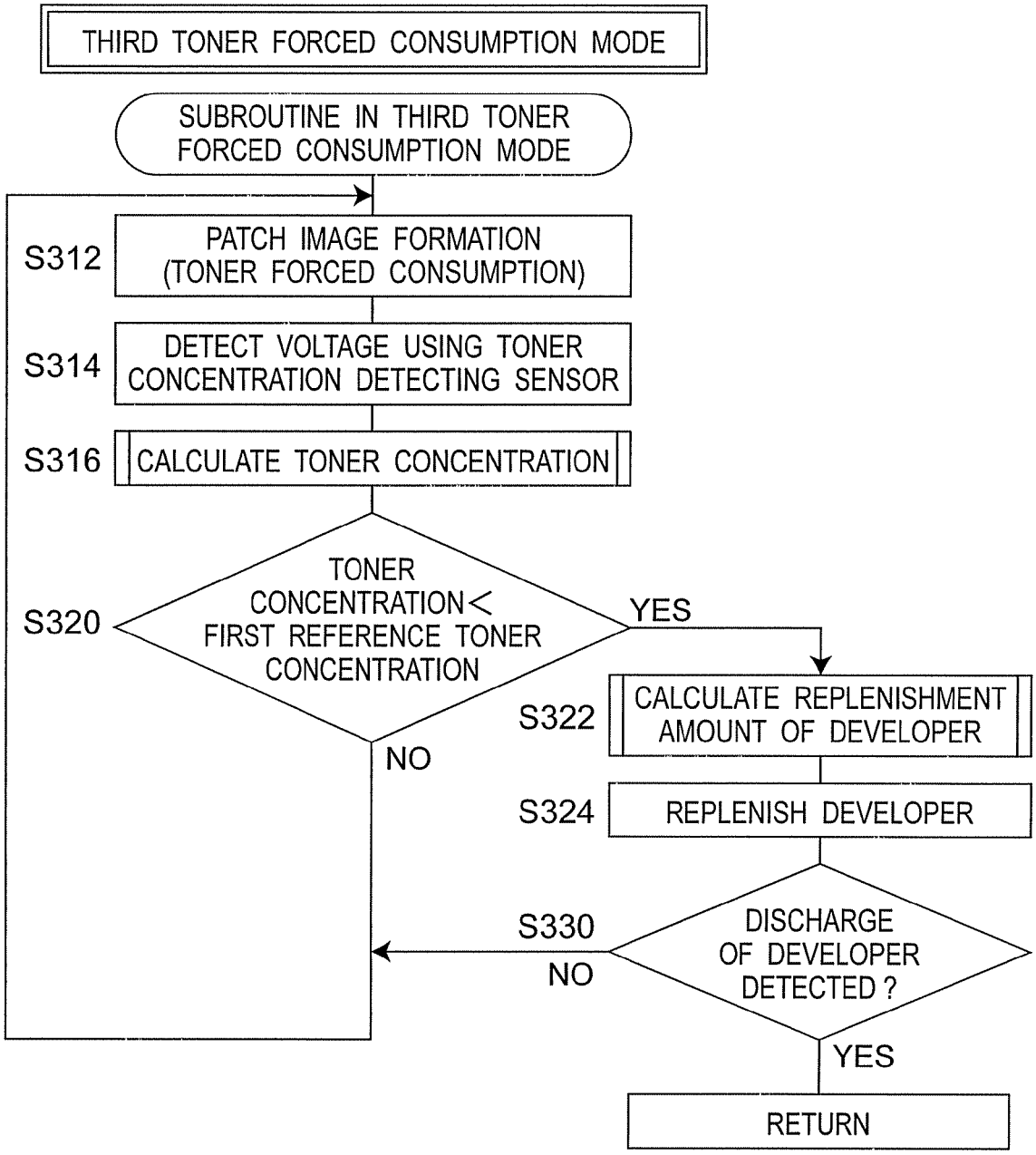
FIG. 7 is a flowchart of a subroutine regarding a third toner forced consumption mode according to a third embodiment.

A FIG. 7 is a flowchart of a subroutine regarding a third toner forced consumption mode according to the third embodiment. Although the description is given while the following specific numeric values are used to facilitate the understanding of the third toner forced consumption mode according to the third embodiment, the numeric values are only examples, and this embodiment is not restricted by the numeric values.

The first reference toner concentration of the developer-tank-contained developer 3 stored in the trickle developing device 34 is 7 wt %, and its storage amount is approximately 250 g. When it is assumed that the second reference toner concentration of the developer-tank-contained developer 3 inside the developing device 34 is the first reference toner forced consumption (7 wt %)+2 wt %, the second reference toner concentration is 9 wt %. The amount of the developer-tank-contained developer 3 stored inside the developing device 34 at the second reference toner concentration (9 wt %) is approximately 210 g. The amount of the toner to be consumed by one patch image formation operation is approximately 0.5 g. The ratio of the carrier in the replenishment developer 2 is 15 wt %. The replenishment amount of the replenishment developer 2 is approximately 0.6 g in one replenishment operation, corresponding to approximately 0.5 g when converted into the amount of the toner.

In the third embodiment, since the subroutine regarding the replenishment control for the developing device 34 is the same as that of the above-mentioned first embodiment, the description thereof is omitted, and only the subroutine regarding the third replenishment control correction mode, different from that of the first embodiment, will be described.

FIG. 7 shows a subroutine regarding the third toner forced consumption mode of the subroutine regarding the replenishment control for the developing device 34, shown in FIG. 4. At step S312, patch image formation in which paper output is not performed after development is carried out for toner forced consumption operation. In this patch image formation, for the purpose that toner is consumed as much as possible by one patch image formation operation, an image is formed in a solid state so as to cover the almost entire face. Approximately 0.5 g of toner is consumed by one patch image formation operation.

At step S314, a voltage signal regarding the toner concentration of the developer-tank-contained developer 3 existing in the developer stirring and conveying chamber 67 is output from the toner concentration detecting sensor 78. At step S316, the output voltage signal is converted by calculation into the value of the toner concentration of the developer-tank-contained developer 3 using the controller 100. At step S320, a judgment is made as to whether the detected current toner concentration of the developer-tank-contained developer 3 is lower than the first reference toner concentration (7 wt %).

At step S330, when the current toner concentration of the developer-tank-contained developer 3 is judged to be equal to or higher than the first reference toner concentration (7 wt %), the process returns to step S312 for patch image formation. In other words, the patch image formation at step S312 is repeated until the current toner concentration of the developer-tank-contained developer 3 becomes lower than the first reference toner concentration (7 wt %). Since patch image formation is repeated, the toner is consumed, and the toner concentration of the developer-tank-contained developer 3 gradually lowers; however, since the replenishment of the replenishment developer 2 is not carried out, the volume level of the developer-tank-contained developer 3 inside the developer tank 55 lowers.

When it is judged at step S320 that the current toner concentration of the developer-tank-contained developer 3 has become lower than the first reference toner concentration (7 wt %), that is, when it is judged that the current toner concentration of the developer-tank-contained developer 3 is restored to the first reference toner concentration as the result of the repetition of the patch image formation, the replenishment amount of the replenishment developer 2 is calculated at step S322 on the basis of the current toner concentration of the developer-tank-contained developer 3. Furthermore, at step S324, the predetermined amount (approximately 0.6 g) of the replenishment developer 2 is replenished, and at step S330, a judgment is made as to whether the developer-tank-contained developer 3 has been discharged into the developer recovery tank 90.

When it is judged at step S330 that the developer-tank-contained developer 3 has not been discharged into the developer recovery tank 90, the process returns to step S312 for patch image formation.

Although the toner is consumed by the patch image formation at step S312, since the replenishment amount (approximately 0.5 g) of the toner is balanced with the consumed amount (approximately 0.5 g), the toner concentration of the developer-tank-contained developer 3 is maintained at the restored value, that is, the first reference toner concentration (7 wt %). As a result, the process goes to YES wherein the judgment at step S320 is made such that the current toner concentration of the developer-tank-contained developer 3 has become substantially lower than the first reference toner concentration (7 wt %). Hence, in addition to the toner consumption operation by the patch image formation at step S312, the replenishment operation of the replenishment developer 2 from step S322 to S330 and the discharge detection of the developer-tank-contained developer 3 are repeated. This means that the replenishment developer 2, that is, the carrier, is being replenished while the current toner concentration of the developer-tank-contained developer 3 is being restored to the first reference toner concentration (7 wt %), in other words, the volume level of the developer-tank-contained developer 3 inside the developer tank 66 rises gradually as the carrier is replenished.

When it is judged at step S330 that the developer-tank-contained developer 3 has been discharged into the developer recovery tank 90, this means that the developer-tank-contained developer 3 inside the developer stirring and conveying chamber 67 flows out from the outlet and actually drops into the developer recovery tank 90 and that the volume level of the developer-tank-contained developer 3 has been restored to the reference volume level; hence, the third toner forced consumption mode ends at step S332.

In the third toner forced consumption mode, the toner concentration and the volume level of the developer-tank-contained developer 3 can be restored accurately to the predetermined values by the replenishment operation of the replenishment developer 2. In the third toner forced consumption mode, the replenishment developer 2 is replenished until the volume level of the developer-tank-contained developer 3 is restored to the predetermined volume level, and a large amount of the replenishment developer 2 is required; hence, the mode is ideally suited in the case that the developer tank 66 of the developing device 34 is small in size.

When general image formation was carried out using the image forming apparatus 1 having the third toner forced consumption mode described above, image loss due to screw irregularity or the like did not occur, and the effect of the third toner forced consumption mode has been verified.

Although the description is given using specific numeric values in the above-mentioned respective embodiments, the present invention is not restricted by the numeric values but can be modified variously without departing from the scope defined in the appended claims and equivalents thereof.

What is claimed is:

1. A developing device having stirring members for stirring a developer-tank-contained developer containing toner and carrier inside a developer tank while conveying the developer and a developer holder disposed adjacent to said stirring members to supply the stirred developer-tank-contained developer to an electrostatic latent image holder, comprising:

a developer replenishing tank for replenishing a replenishment developer containing the toner and the carrier to said developer tank, a toner concentration detecting sensor for detecting the toner concentration inside said developer tank, a discharging mechanism provided in said developer tank to discharge an excessive amount of the developer-tank-contained developer outside said developer tank when the amount of the developer-tank-contained developer inside said developer tank exceeds a predetermined amount, and control unit for replenishing the replenishment developer when it is detected that the toner concentration inside said developer tank is lower than a first reference value and for forcibly consuming the toner inside said developer tank and replenishing the replenishment developer when it is detected that the toner concentration inside said developer tank is higher than a second reference value that is higher than said first reference value.

2. The developing device according to claim 1, wherein the replenishment amount of the replenishment developer at the time when it is detected that the toner concentration inside said developer tank is higher than said second reference value is made larger than the forced consumption amount of the toner inside said developer tank.

3. The developing device according to claim 2, wherein when it is detected that the toner concentration inside said developer tank is higher than said second reference value, said control unit carries out the operation of forcibly consuming the toner inside said developer tank until it is detected that the toner concentration inside said developer tank is lower than said first reference value, and after it is detected that the toner concentration inside said developer tank is lower than said first reference value, said control unit carries out the operation of forcibly consuming the toner inside said developer tank and the replenishment operation of the replenishment developer concurrently.

4. The developing device according to claim 2, wherein when it is detected that the toner concentration inside said developer tank is higher than said second reference value, said control unit carries out the operation of forcibly consuming the toner inside said developer tank a predetermined number of times, and said control unit carries out the operation of forcibly consuming the toner inside said developer tank and the replenishment operation of the replenishment developer concurrently a predetermined number of times, and then said control unit carries out the operation of forcibly consuming the toner inside said developer tank until it is detected that the toner concentration inside said developer tank is lower than said second reference value.

5. The developing device according to claim 2, wherein said developing device further comprises a developer discharge detecting sensor for detecting whether the developer-tank-contained developer is discharged from said discharging mechanism, and when it is detected that the toner concentration inside said developer tank is higher than said second reference value, said control unit carries out the operation of forcibly consuming the toner inside said developer tank and the replenishment operation of the replenishment developer concurrently until the discharge of the developer-tank-contained developer is detected.

6. The developing device according to claim 1, wherein the operation of forcibly consuming the toner inside said developer tank is done by attaching the toner inside said developer tank to said electrostatic latent image holder.

7. The developing device according to claim 6, wherein when it is detected that the toner concentration inside said developer tank is higher than said second reference value, said control unit carries out the operation of forcibly consuming the toner inside said developer tank until it is detected that the toner concentration inside said developer tank is lower than said first reference value, and after it is detected that the toner concentration inside said developer tank is lower than said first reference value, said control unit carries out the operation of forcibly consuming the toner inside said developer tank and the replenishment operation of the replenishment developer concurrently.

8. The developing device according to claim 6, wherein when it is detected that the toner concentration inside said developer tank is higher than said second reference value, said control unit carries out the operation of forcibly consuming the toner inside said developer tank a predetermined number of times, and said control unit carries out the operation of forcibly consuming the toner inside said developer tank and the replenishment operation of the replenishment developer concurrently a predetermined number of times, and then said control unit carries out the operation of forcibly consuming the toner inside said developer tank until it is detected that the toner concentration inside said developer tank is lower than said second reference value.

9. The developing device according to claim 6, wherein said developing device further comprises a developer discharge detecting sensor for detecting whether the developer-tank-contained developer is discharged from said discharging mechanism, and when it is detected that the toner concentration inside said developer tank is higher than said second reference value, said control unit carries out the operation of forcibly consuming the toner inside said developer tank and the replenishment operation of the replenishment developer concurrently until the discharge of the developer-tank-contained developer is detected.

10. The developing device according to claim 1, wherein when it is detected that the toner concentration inside said developer tank is higher than said second reference value, said control unit carries out the operation of forcibly consuming the toner inside said developer tank until it is detected that the toner concentration inside said developer tank is lower than said first reference value, and after it is detected that the toner concentration inside said developer tank is lower than said first reference value, said control unit carries out the operation of forcibly consuming the toner inside said developer tank and the replenishment operation of the replenishment developer concurrently.

11. The developing device according to claim 1, wherein when it is detected that the toner concentration inside said developer tank is higher than said second reference value, said control unit carries out the operation of forcibly consuming the toner inside said developer tank a predetermined number of times, and said control unit carries out the operation of forcibly consuming the toner inside said developer tank and the replenishment operation of the replenishment developer concurrently a predetermined number of times, and then said control unit carries out the operation of forcibly consuming the toner inside said developer tank until it is detected that the toner concentration inside said developer tank is lower than said second reference value.

12. The developing device according to claim 1, wherein said developing device further comprises a developer discharge detecting sensor for detecting whether the developer-tank-contained developer is discharged from said discharging mechanism, and when it is detected that the toner concentration inside said developer tank is higher than said second reference value, said control unit carries out the operation of forcibly consuming the toner inside said developer tank and the replenishment operation of the replenishment developer concurrently until the discharge of the developer-tank-contained developer is detected.

13. An image forming apparatus having a rotatable electrostatic latent image holder for holding electrostatic latent images on the circumferential face thereof, stirring members for stirring a developer-tank-contained developer containing toner and carrier inside a developer tank while conveying said developer, and a developer holder disposed adjacent to said stirring members to supply the stirred developer-tank-contained developer to said electrostatic latent image holder, comprising:

a developer replenishing tank for replenishing a replenishment developer containing the toner and the carrier to said developer tank, a toner concentration detecting sensor for detecting the toner concentration inside said developer tank, a discharging mechanism provided in said developer tank to discharge an excessive amount of the developer-tank-contained developer outside said developer tank when the amount of the developer-tank-contained developer inside said developer tank exceeds a predetermined amount, and control unit for replenishing the developer-tank-contained developer when it is detected that the toner concentration inside said developer tank is lower than a first reference value and for forcibly consuming the toner inside said developer tank and replenishing the replenishment developer when it is detected that the toner concentration inside said developer tank is higher than a second reference value that is higher than said first reference value.

14. The image forming apparatus according to claim 13, further comprising transfer unit for transferring a toner image developed into a visible image using said developer holder onto paper from the circumferential face of said electrostatic latent image holder and a cleaning device for removing non-transferred toner from the surface of said electrostatic latent image holder, wherein forcibly consumed toner is not transferred onto the paper but is recovered using said cleaning device.

15. The image forming apparatus according to claim 14, wherein when it is detected that the toner concentration inside said developer tank is higher than said second reference value, said control unit carries out the operation of forcibly consuming the toner inside said developer tank until it is detected that the toner concentration inside said developer tank is lower than said first reference value, and after it is detected that the toner concentration inside said developer tank is lower than said first reference value, said control unit carries out the operation of forcibly consuming the toner inside said developer tank and the replenishment operation of the replenishment developer concurrently.

16. The image forming apparatus according to claim 14, wherein when it is detected that the toner concentration inside said developer tank is higher than said second reference value, said control unit carries out the operation of forcibly consuming the toner inside said developer tank a predetermined number of times, and said control unit carries out the operation of forcibly consuming the toner inside said developer tank and the replenishment operation of the replenishment developer concurrently a predetermined number of times, and then said control unit carries out the operation of forcibly consuming the toner inside said developer tank until it is detected that the toner concentration inside said developer tank is lower than said second reference value.

17. The image forming apparatus according to claim 14, wherein said image forming apparatus further comprises a developer discharge detecting sensor for detecting whether the developer-tank-contained developer is discharged from said discharging mechanism, and when it is detected that the toner concentration inside said developer tank is higher than said second reference value, said control unit carries out the operation of forcibly consuming the toner inside said developer tank and the replenishment operation of the replenishment developer concurrently until the discharge of the developer-tank-contained developer is detected.

18. The image forming apparatus according to claim 13, wherein when it is detected that the toner concentration inside said developer tank is higher than said second reference value, said control unit carries out the operation of forcibly consuming the toner inside said developer tank until it is detected that the toner concentration inside said developer tank is lower than said first reference value, and after it is detected that the toner concentration inside said developer tank is lower than said first reference value, said control unit carries out the operation of forcibly consuming the toner inside said developer tank and the replenishment operation of the replenishment developer concurrently.

19. The image forming apparatus according to claim 13, wherein when it is detected that the toner concentration inside said developer tank is higher than said second reference value, said control unit carries out the operation of forcibly consuming the toner inside said developer tank a predetermined number of times, and said control unit carries out the operation of forcibly consuming the toner inside said developer tank and the replenishment operation of the replenishment developer concurrently a predetermined number of times, and then said control unit carries out the operation of forcibly consuming the toner inside said developer tank until it is detected that the toner concentration inside said developer tank is lower than said second reference value.

20. The image forming apparatus according to claim 13, wherein said image forming apparatus further comprises a developer discharge detecting sensor for detecting whether the developer-tank-contained developer is discharged from said discharging mechanism, and when it is detected that the toner concentration inside said developer tank is higher than said second reference value, said control unit carries out the operation of forcibly consuming the toner inside said developer tank and the replenishment operation of the replenishment developer concurrently until the discharge of the developer-tank-contained developer is detected.

* * * * *